US010459405B2

(12) United States Patent
Vardi

(10) Patent No.: US 10,459,405 B2
(45) Date of Patent: Oct. 29, 2019

(54) TUNING FORK MECHANICAL OSCILLATOR FOR CLOCK MOVEMENT

(71) Applicant: THE SWATCH GROUP RESEARCH AND DEVELOPMENT LTD., Marin (NE) (CH)

(72) Inventor: Ilan Vardi, Neuchatel (CH)

(73) Assignee: THE SWATCH GROUP RESEARCH AND DEVELOPMENT LTD., Marin (NE) (CH)

( * ) Notice: Subject to any disclaimer, the term of this patent is extended or adjusted under 35 U.S.C. 154(b) by 0 days.

(21) Appl. No.: 15/309,342

(22) PCT Filed: May 1, 2015

(86) PCT No.: PCT/EP2015/059624

§ 371 (c)(1),
(2) Date: Nov. 7, 2016

(87) PCT Pub. No.: WO2015/169708

PCT Pub. Date: Nov. 12, 2015

(65) Prior Publication Data

US 2017/0108830 A1 Apr. 20, 2017
US 2018/0004160 A9 Jan. 4, 2018

(30) Foreign Application Priority Data

May 5, 2014 (EP) ..... 14167078

(51) Int. Cl.
*G04B 17/20* (2006.01)
*G04B 17/04* (2006.01)
*G04B 17/22* (2006.01)

(52) U.S. Cl.
CPC ..... *G04B 17/045* (2013.01); *G04B 17/20* (2013.01); *G04B 17/227* (2013.01)

(58) Field of Classification Search
CPC ..... G04B 17/04; G04B 17/22; G04B 17/227; G04B 17/045; H03H 9/205; H03H 9/21; H03H 9/17
See application file for complete search history.

(56) References Cited

U.S. PATENT DOCUMENTS 3,269,106 A * 8/1966 Waldburger ..... G04B 17/04 368/168
3,736,743 A * 6/1973 Koike ..... G04B 17/045 368/168

(Continued)

OTHER PUBLICATIONS

Silicon—http://www.sciencedirect.com/science/article/pii/S0921509309002391—Nov. 9, 2017.*

(Continued)

*Primary Examiner* — Sean P Kayes
(74) *Attorney, Agent, or Firm* — Oblon, McClelland, Maier & Neustadt, L.L.P.

(57) ABSTRACT

The present invention relates to a wristwatch comprising a mechanical clock movement with a tuning fork resonator. The oscillator preferably comprises a material A with a low internal friction. In the oscillator of the invention, the unwanted symmetrical oscillations are avoided, for example, by the choice of the materials from which the tuning fork is manufactured. According to preferred embodiments, the rod and/or fastening of the oscillator comprises a material having greater internal friction than that of said material A, such that the quality factor $Q_2$ of the symmetrical oscillations is reduced, in contrast to the quality factor $Q_1$ of the anti symmetrical oscillation mode.

16 Claims, 4 Drawing Sheets

(56) References Cited

U.S. PATENT DOCUMENTS

| | | | | |
|---|---|---|---|---|
| 3,760,482 | A * | 9/1973 | Kawamura | G04C 3/107<br>29/896.22 |
| 9,016,932 | B2 * | 4/2015 | Hessler | G04B 17/066<br>368/168 |
| 2014/0219067 | A1 * | 8/2014 | Hessler | G04B 17/066<br>368/168 |

OTHER PUBLICATIONS

Steel—http://www.sciencedirect.com/science/article/pii/S0921509306026244#tbl3—Nov. 9, 2017.*

* cited by examiner

TUNING FORK MECHANICAL OSCILLATOR FOR CLOCK MOVEMENT

This application is a § 371 application of PCT/EP2015/059624, filed May 1, 2015, which claims priority to EP 14167078.6, filed May 5, 2014. The entire disclosure of each of the foregoing applications is incorporated by reference herein.

TECHNICAL FIELD

The present invention relates to a tuning fork oscillator, a clock movement containing the oscillator and a timepiece including the oscillator. In particular, the invention relates to a mechanical timepiece having the oscillator.

STATE OF THE ART AND PROBLEMS FORMING THE BACKGROUND TO THE INVENTION

An aim of the present invention is to improve the performance of the mechanical movement of a timepiece, particularly that of a mechanical timepiece. The balance spring, long used as an oscillator in mechanical watches, has proved its worth, but in spite of, or maybe because of, centuries of research and development, it is possible that it is nearing its limits. Hence, the best balance springs achieve a quality factor Q of about 300. With the quality factor of an oscillator being defined by the equation $Q=2\pi\times$(energy stored/energy loss per period), it essentially represents the number of oscillations after which the oscillator loses its entire energy and stops.

The tuning fork is well known for its time base qualifies; the tuning fork movement wristwatches of the 1960's were the most accurate in the world until the advent of the quartz watch. Max Hetzel is the originator of many patented inventions relating to use of a tuning fork as an oscillator, resulting in production of the Accutron wristwatch (registered trademark), marketed by the company Bulova Swiss SA.

The Accutron watch however comprises an electronic resonator since each branch of the tuning fork bears a permanent magnet associated with an electromagnet rigidly mounted on the frame of the watch. The operation of each electromagnet is slaved to the vibrations of the tuning fork by means of the magnets that it bears, such that the vibrations of the tuning fork are sustained by the transmission of periodic magnetic pulses of the electromagnets to the permanent magnets. One of the branches of the tuning fork actuates a ratchet making it possible to rotate the mobiles of the going train of the watch.

U.S. Pat. No. 2,971,323 for example, derived from an application dating from 1957, describes a mechanism only suitable however for producing a purely mechanical watch, i.e. devoid of electronic circuits. A genuine need in fact exists, in terms of market, for purely mechanical timepieces displaying an increased precision of watch operation in relation to the known pieces.

An overall difference between mechanical wristwatches and acoustic tuning fork-based electronic watches lies in the fact that in the latter, the oscillator as the timekeeper also serves as an energy distributor, i.e. the oscillations are used to power the movement (Accutron) or determine the activity of an electric motor that acts on the watch hands (quartz-based electronic watch). In mechanical watches on the other hand, regulation is performed at the end of the energy transmission chain.

U.S. Pat. No. 3,208,287, derived from an application dating from 1962, describes a resonator comprising a tuning fork coupled to an escapement wheel by means of magnetic interactions. More specifically, the tuning fork bears permanent magnets interacting with the escapement wheel, with the latter being made of magnetic conductive material. The escapement wheel is cinematically connected to an energy source, which may be mechanical or adopt the form of a motor, while it has openings in its thickness such as to form a variable reluctance magnetic circuit when driven in rotation, in relation to the magnets borne by the tuning fork. This patent discloses "abnormal oscillation, illustrated in FIG. 9. This in fact involves symmetrical oscillation which, according to this patent, can be avoided by positioning the escapement wheel so as to act, simultaneously, on both prongs of the oscillator, as shown in FIGS. 2 and 3. This solution resembles that used in quartz-based electronic watches (and likewise in the Accutron watch mentioned above) in that the symmetrical mode of oscillation is imposed by the simultaneous impulsion of both prongs.

In relation to U.S. Pat. No. 3,208,287, the present invention seeks to solve several technical problems. On the one hand, it is desired to induce an antisymmetrical oscillation by acting on a single prong of the tuning fork; therefore, without imposing antisymmetrical oscillation by simultaneous impulsion of both prongs. On the other hand, use of magnets to distribute the energy to an oscillator (impulsion by escapement) or moreover to regulate an energy is not strictly speaking "mechanical", for the simple reason that the energy is transmitted by magnetic forces and is therefore associated with electromagnetic phenomena.

This same reasoning is valid for the teaching of European patent application EP 2 466 401.

In the light of the above, the present invention aims to provide a mechanical movement watch comprising a more accurate time base than that of the conventional balance spring. It is therefore an aim of the present invention to offer an oscillator characterised by a quality factor higher than that of the balance spring.

In particular, an aim of the invention is to provide a wristwatch with entirely mechanical movement using a tuning fork oscillator as the time base.

An aim of the present invention is to avoid, in a tuning fork oscillator, the symmetrical oscillations. More specifically, the present invention aims to avoid the symmetrical oscillations in an oscillator comprising a material characterised by low internal friction, in order to make the oscillator able to perform said symmetrical oscillations.

An aim of the invention is to provide a tuning fork based on a material having low internal friction, such as monocrystalline silicon. Use of such a material allows an increase in the quality factor Q of the oscillations, but makes the tuning fork able to perform symmetrical oscillations not desired within the context of a time base.

An aim of the present invention is to make available an oscillator in which the antisymmetrical oscillations are encouraged, even if the impulses are transmitted to one of the prongs only; in other words, in the absence of impulses simultaneous to both prongs.

The present invention seeks to solve the above problems and offers other advantages that will appear more clearly upon reading the description and the claims.

Summary of Invention

In an aspect, the present invention relates to a timepiece comprising a mechanical clock movement comprising: a tuning fork oscillator, wherein said oscillator comprises an assembly having two prongs and a base connecting said prongs, wherein said oscillator comprises a rod connected to said base, the oscillator being connected by its rod to a fastening member connected to the movement, wherein said assembly comprises or consists of a material A, said material A being characterised by low internal friction, wherein said movement comprises a mechanical impulsion element able to act on one of the two prongs so as to induce and sustain oscillation of said oscillator, wherein said oscillator is able to oscillate both in a desired antisymmetrical mode and in an unwanted symmetrical mode, characterised in that the quality factor $Q_2$ of the symmetrical oscillation mode of said oscillator is reduced in relation to the quality factor $Q_1$ of the antisymmetrical oscillation mode.

In an aspect, the present invention relates to a tuning fork oscillator, wherein said oscillator comprises an assembly having two prongs and a base connecting said prongs, wherein said oscillator comprises a rod connected to said base, the oscillator being connected by its rod to a fastening member connected to a support, wherein said assembly is formed of a material A, characterised by low internal friction, wherein said oscillator is able to oscillate both in a desired antisymmetrical mode and in an unwanted symmetrical mode, characterised in that the quality factor $Q_2$ of the symmetrical oscillation mode of said oscillator is reduced in relation to the quality factor $Q_1$ of the antisymmetric oscillation mode.

In an aspect, the present invention relates to a tuning fork oscillator, wherein said oscillator comprises two prongs and a base connecting said prongs, wherein said oscillator comprises a rod connected to said base, characterised in that, in said oscillator, a symmetrical oscillation mode is damped or prevented by the presence of a material selected in or on said oscillator and/or in or on a fastening of the oscillator.

In an aspect, the present invention relates to a tuning fork oscillator, wherein said oscillator comprises two prongs and a base connecting said prongs, wherein said oscillator comprises a rod connected to said base, the oscillator being connected by its rod to a fastening, wherein said oscillator is manufactured from one or several materials rendering said oscillator able to perform symmetrical oscillations and wherein said oscillator or the fastening furthermore comprise another material able to damp said symmetrical oscillations.

In an aspect, the present invention relates to a tuning fork oscillator, wherein said oscillator comprises two prongs and a base connecting said prongs, wherein said oscillator comprises a rod connected to said base, the oscillator being connected by its rod to a fastening, wherein said oscillator comprises or is manufactured from several materials including a material A and a material A', wherein material A' is characterised by a thermal expansion coefficient of opposite sign to that of material A.

In an aspect, the present invention relates to a movement for a timepiece comprising the oscillator in addition to a timepiece including the oscillator.

In an aspect, the present invention relates to use of a material possessing a comparatively high internal friction in order to avoid symmetrical oscillation in a tuning fork oscillator.

DESCRIPTION OF THE DRAWINGS

The characteristics and advantages of the invention appear more clearly on reading the following description of a preferred embodiment, the description being given merely by way of non-limiting example, and with reference to the accompanying diagrammatic drawings, in which:

FIGS. 3 B and 3 C represent diagrammatic views of the antisymmetrical and symmetrical oscillations, respectively, of the oscillator in FIG. 3 A.

FIGS. 4 B and 4 C represent diagrammatic views of the antisymmetrical and symmetrical oscillations, respectively, of the oscillator in FIG. 4 A.

DETAILED DESCRIPTION OF PREFERRED EMBODIMENTS

The present invention relates to a tuning fork oscillator, in addition to a timepiece comprising the oscillator and furthermore a movement for a timepiece including the oscillator.

The timepiece according to the invention may be a watch, a pocket watch, a pendant watch, a pendulum clock, or furthermore a table clock for example. In a preferred embodiment, the timepiece according to the invention is a wristwatch.

The timepiece according to the invention may be entirely mechanical and/or may comprise an entirely mechanical movement. Preferably, an entirely mechanical movement can operate in the absence of any electronic circuit, particularly in the absence of an electric power source, such as a battery or a photovoltaic cell for example. The present invention also allows production of a timepiece that operates based on mechanical interactions between the set of components and excluding magnetic interactions. In an entirely mechanical movement, the impulses for inducing and sustaining oscillation of the oscillator are furnished by a component which acts by direct physical contact on the tuning fork or on a component integral with the tuning fork. The present invention may for example represent an improvement on the solutions proposed in the patent documents EP 2 466 401 or moreover U.S. Pat. No. 3,208,287, which disclose a resonator in which the oscillator and the escapement wheel bear magnets, for example permanent magnets, in order to form a regulation and escapement mechanism based on magnetic interactions.

According to an embodiment, the movement of the invention comprises a mechanical impulsion member which is connected and/or supplied by a mechanical energy source. The mechanical energy source may be the same as in a conventional mechanical watch; for example, the energy may originate from a mainspring which can be wound up manually or automatically for example.

While the present invention allows operation of a movement for an entirely mechanical timepiece, those skilled in the art will be able to apply the technical solutions disclosed in the present description in the case of an electronic watch or furthermore in a mechanical watch using magnetic interactions.

Indeed, the present invention allows, for the first time, production of an entirely mechanical timepiece movement with a tuning fork oscillator. The proposed solution is however applicable to any time base based on a resonator or tuning fork oscillator.

Figure 1:
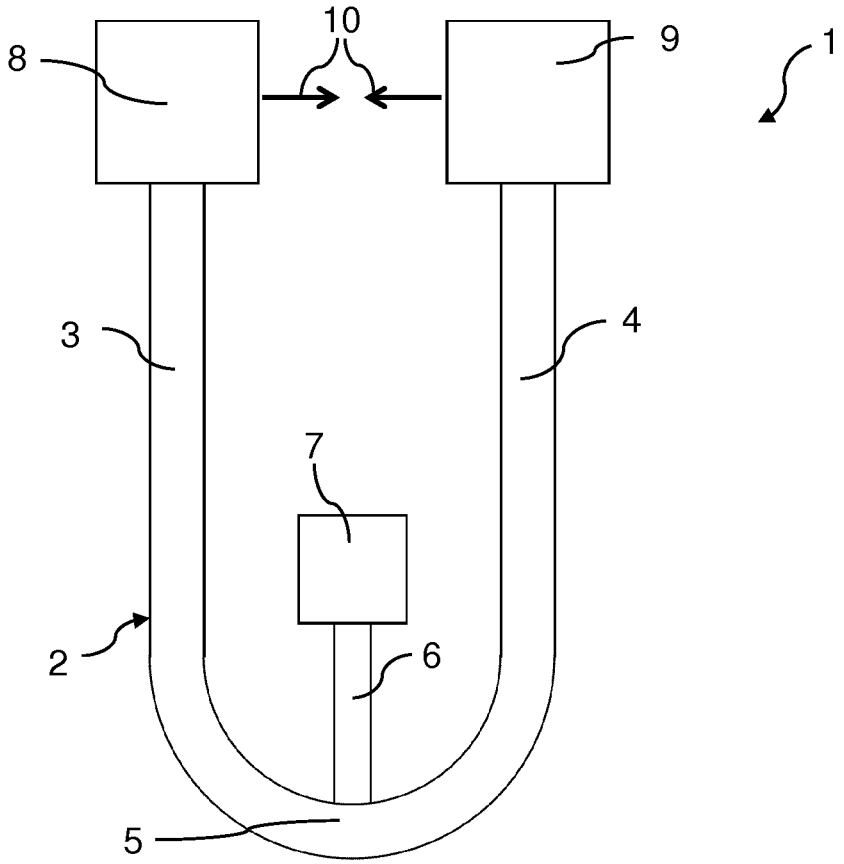
FIG. 1 represents a diagrammatic view of a watchmaking tuning fork.

FIG. 1 shows the general form of a watchmaking tuning fork. The tuning fork 1 comprises the two prongs or branches 3 and 4, connected by the base 5 so as to form the overall shape of a U. The two prongs 2 and 3 are preferably arranged parallel in a single plane. The two prongs 3 and 4 are preferably of the same length. The ends of the prongs 3 and 4 are free on the side opposite the base 5. They preferably each bear a weight 8, 9 respectively, serving to reduce the frequency of the oscillations of the tuning fork 1. The tuning fork comprises a rod 6 by means of which the base 5 is connected to a fastening member 7. One end of the rod 6 is therefore connected to the base 5 whereas the other end is connected to the fastening 7.

In the case of a watch, the fastening 7 is preferably made integral with the movement of the watch. For example, the fastening 7 is connected by screwing for instance to the plate or a bridge. If the timepiece is not a watch or if the oscillator of the invention is not associated with a timepiece, the fastening 7 can be fixed to any kind of support.

Figure 2A:
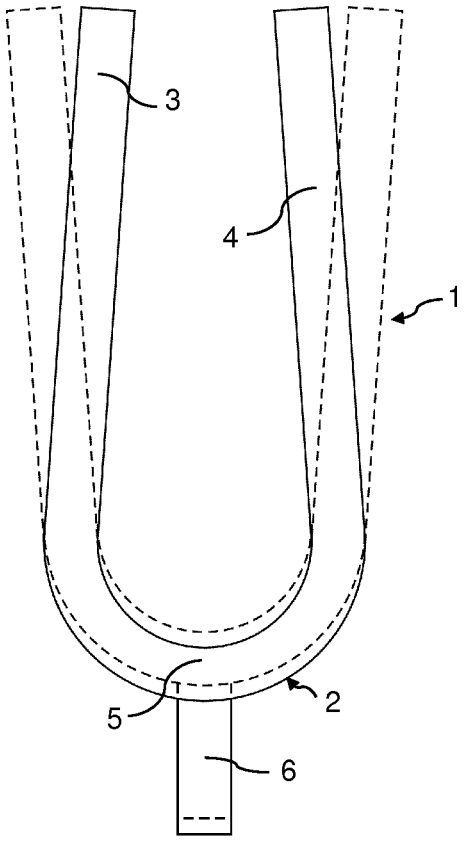
FIGS. 2 A and 2 B illustrate the antisymmetrical and symmetrical oscillation, respectively of a tuning fork.
Figure 2B:
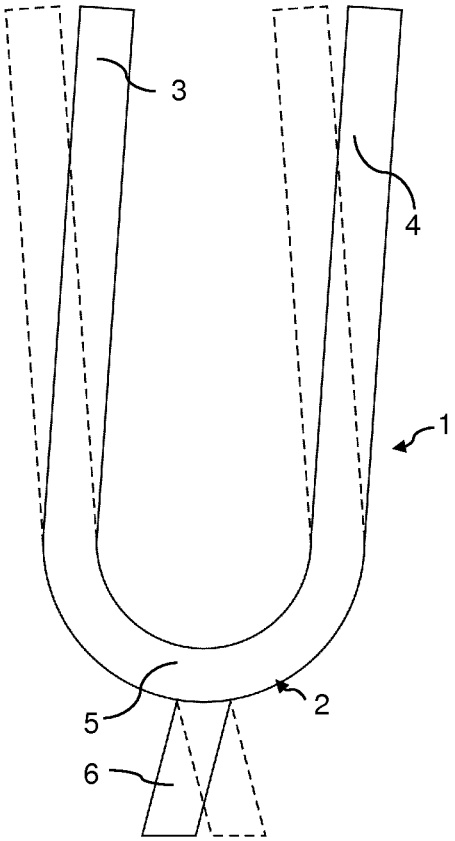

In order to minimise dimensions, the rod 6 is preferably located above the base 5. It could also be located below the base 5, as shown in FIGS. 2 A and 2 B, which does not change the behaviour of the tuning fork in any way.

The value of the tuning fork mainly lies in the fact that its quality factor Q is much higher than that of a single vibrating prong. Without wishing to be bound by theory, the high quality factor Q of the tuning fork compared to that of a single vibrating prong is related to the U-shaped configuration and the oscillation modes resulting therefrom. P. Ong, "Little known facts about the common tuning fork", Phys. Educ. 37 (2002), 540-542.

For the purpose of further increasing the quality factor Q of the oscillator, the latter comprises or is preferably made of a material having low or very low internal friction. A sophisticated model of explanation of the quality factor takes account of the viscous internal friction of the branches and base of the tuning fork, as described by Andres Castellanos-Gomez, Nicolas Agrait, Gabino Rubio-Bollinger, "Force gradient-induced mechanical dissipation of quartz tuning fork force sensors used in atomic force microscopy", Ultramicroscopy (2011) 111 (3), 186-190.

Materials that fulfill the criterion of low internal friction include, for example, monocrystalline silicon or quartz. Other materials possessing internal frictions that are similar and/or of the same order of magnitude may of course also be used. Generally speaking, other monocrystalline materials may be used in manufacturing the oscillator 1 according to the invention.

It should be pointed out that the oscillator 1 in its entirety may comprise or be manufactured from several materials. For example, the weights 8 and 9 are typically made of gold or another dense material, for instance another heavy precious metal. The weights 8 and 9 allow a reduction in the frequency of the oscillator if desired, which may be the case in a mechanical timepiece. The present invention also covers the possibility of the weights 8 and 9 being zero or absent. Furthermore, the weights 8, 9 may be positioned or oriented differently to the arrangement shown in FIG. 1, as disclosed for example in U.S. Pat. No. 3,447,311. The weights 8, 9 may be executed in the form of layers deposited on the prongs 3 and 4 and/or may be connected close to, or in the area of the ends and be oriented as shown in U.S. Pat. No. 3,447,311 for example.

Furthermore, the prongs 3, 4 may be formed of several materials having low internal friction, as will be described further below. Next, the rod 6 and/or fastening 7 preferably comprises a material with higher internal friction, as will be described below.

It is preferably however that the oscillator should comprise an assembly 2 formed of at least the prongs 3 and 4 and of the base 5. This assembly 2 preferably comprises an entity formed of a continuous single material. This should not prevent the presence of other materials, as set forth in this description. According to the present invention, the oscillator 1 comprises an assembly 2 formed of a material A characterised by low internal friction. For example, the material A is selected from among the low-internal-friction materials described above, such as for example monocrystalline silicon or quartz, or monocrystalline materials in general. According to an embodiment, said oscillator 1, or at least said assembly 2, comprises or is made of monocrystalline silicon and/or quartz.

According to an embodiment, the rod 6 comprises and/or is made of the same material A. According to this embodiment, the rod 6 forms part of the assembly 2. According to another embodiment, the rod 6 comprises and/or is made of another material.

Since the assembly 2 comprises or is preferably made of one or several materials with low internal friction (materials A and if appropriate material A' described further below), the quality factor Q of the oscillator is higher than in the case of a metal oscillator for example. This increase in the quality factor Q likewise applies to oscillation modes that may be described as unwanted in an oscillator serving as a time base.

FIGS. 2 A and 2 B illustrate two oscillation modes of a tuning fork 1 following an impulse. The dotted and solid lines show, respectively, the two positions of the peak-to-peak amplitude of the oscillator, i.e. the two positions that define the maximum excursion in relation to the resting point where the prongs 3 and 4 are parallel.

In the oscillation mode shown in FIG. 2 A, the prongs 3 and 4 move towards and away from each other during the oscillations. The solid line shows the moment and position of oscillation where the ends of the two prongs are close together and the dotted line shows the position where the two prongs are distant from each other. It is the antisymmetrical oscillation mode that is characterised by a very high quality factor and which represents the oscillation mode that one wishes to obtain in a tuning fork time base.

Conversely, in the oscillation mode shown in FIG. 2 B, the prongs 3, 4 move in phase, i.e. oscillate in parallel and simultaneously from one side to another in the same plane. The oscillation illustrated in FIG. 2 B is that of the symmetrical oscillation mode.

Both oscillation modes, antisymmetrical and symmetrical respectively, are also illustrated in U.S. Pat. No. 3,208,287, in which the unwanted symmetrical mode (FIG. 2 A) is considered "abnormal oscillation".

In both cases of FIGS. 2 A and 2 B, the oscillations occur in the plane of the oscillator itself, i.e. in the plane corresponding to that on which the drawing in FIGS. 2 A and 2 B is illustrated. The other oscillation modes that might exist do not have the same involvement within the context of the present invention.

It should be added that the problems related to the symmetrical oscillation mode arise above all in cases in which the oscillator is made of a material with a low internal friction, such as quartz or monocrystalline silicon for example. Indeed, the symmetrical oscillation mode (FIG. 2 B) is not observed in metallic tuning forks for example. In other words, choice of the material with low internal friction, material A for example, renders said oscillator able to oscillate not only in the desired antisymmetrical mode, but also in the unwanted symmetrical mode.

In general, the symmetrical oscillation mode is encouraged by mechanical excitation owing to a slightly lower quality factor, therefore easier to "encounter". The latter point applies in particular to impulsion on only one of the two prongs, whether this impulsion is mechanical or otherwise.

A difference between the two antisymmetrical and symmetrical oscillation modes illustrated in FIGS. 2 A and 2 B involves the rod 6. As can be understood by comparing the dotted and solid lines of the rod 6 in FIG. 2 B, the symmetrical mode induces transverse oscillation of the rod 6, corresponding to oscillation of a single vibrating prong. This transverse oscillation generally occurs in the plane defined by the two prongs 3, 4.

Conversely, in the case of antisymmetrical oscillation (FIG. 2 A), the rod 6 executes longitudinal and/or axial oscillations along the axis of the rod 6.

In the case of electric quartz watches (FIG. 2 B), the symmetrical oscillations (FIG. 2 B) are generally avoided by simultaneous excitation of both prongs 3 and 4, utilising the piezoelectric properties of quartz. Simultaneous impulsion (at the same time) of the two prongs 3, 4 is illustrated by the two arrows 10 pointing in opposite directions in FIG. 1. Generally, in an electronic watch, the electrodes are positioned on or close to the prongs in order to be able to induce an antisymmetrical oscillation. In general, electronic methods or algorithms are applied in order to prevent symmetrical oscillation in electronic watches.

Simultaneous impulsion of both branches is also disclosed in document U.S. Pat. No. 3,208,287. Finally, in the Accutron watch mentioned above, the impulsion of the metallic tuning fork also occurs on both prongs simultaneously.

An aim of the present invention is to implement alternative solutions in order to prevent the symmetrical oscillation mode of a tuning fork oscillator, preferably in a resonator used as a time base.

A particular aim of the present invention involves implementing a tuning fork oscillator that can be induced to oscillate antisymmetrically following an impulse on a single prong, therefore in the absence of a simultaneous impulse on both prongs.

An impulse on only one of the two prongs of a tuning fork represents the preferred solution in the case of a mechanical resonator, i.e. time bases in which the oscillations of the tuning fork are induced and sustained mechanically, without use of electricity, electronics or piezoelectricity. According to a preferred embodiment of a mechanical movement and/or mechanical timepiece of the invention, the oscillations are induced and sustained without use of magnetism.

In a preferred embodiment, the movement of the invention and/or timepiece of the invention comprises a mechanical member or impulsion mechanism capable of acting on one of the two prongs of a tuning fork so as to induce and sustain the latter's oscillation. Such a member or mechanism is disclosed for example in international patent application WO2013/045573, submitted on 27 Sep. 2012 in the name of ASGALIUM UNITEC SA under application number PCT/EP2012/069122. The contents of this patent application are explicitly included by reference.

Patent application WO2013/045573 discloses a tuning fork mechanical resonator for a mechanical clock movement with a free escapement. A prong of this tuning fork bears at least one first pin associated with at least one first fork tooth of a pallet assembly to cause this assembly to pivot between the first and second angular positions and alternately lock and release an escapement wheel. The resonator comprises a conversion member secured to the pin and designed to on the one hand, convert the oscillations of the prong into rotational movements of the pallet assembly by transmitting impulses thereto and on the other hand, transmit mechanical energy from said pallet assembly to the prong of the oscillator in the form of impulses. According to an embodiment of the mechanical and/or regulation member, a support bearing pins is fixed to the end of one of the two prongs. The pins collaborate with teeth, defining a pallet fork. The pallet assembly comprises a frame pivotally mounted on the movement in addition to a pair of arms, each of which bears a tooth designed to interact with the pins on the support. The pallet assembly next has a second pair of additional arms, each of which bears a pallet arranged to collaborate with an escapement wheel. The resonator of patent application WO2013/045573 functions similarly to that of conventional resonators owing to the fact that the oscillator bears two pins instead of a single pin and likewise owing to the particular geometry of the pallet fork. Thus, the pallet assembly is designed to pivot between a first position in which one of the pallets locks the escapement wheel in rotation and a second position in which the other pallet locks the escapement wheel. When the pallet assembly pivots between one position and the other, the escapement wheel is free to rotate. The pivoting movement of the pallet assembly is also used to transmit an impulse to one of the two pins of the support in order to sustain the oscillations of the prong and hence the tuning fork in its entirety. In another embodiment, the conversion member comprises a rocker and functions according to the lever arm principle. A free end of the rocker is pivotally mounted on the free end of a prong and the other end is engaged between the teeth of the pallet assembly in order to collaborate with the latter and cause the pallet assembly to pivot.

The person skilled in the art can understand that the device disclosed in patent application WO 2013/045573 serves both for distribution of energy to the tuning fork and regulation of time based on the oscillations.

Patent application WO2013/045573 thus discloses a mechanical impulsion member capable of acting on one of the two prongs in order to induce and sustain oscillation of said oscillator. A mechanical impulsion element is preferably used in the timepiece according to the present invention.

According to a preferred embodiment, the quality factor $Q_2$ of the symmetrical oscillation mode of the oscillator of the invention is actively and deliberately reduced in relation to the quality factor $Q_1$ of the antisymmetrical oscillation mode. According to this embodiment, the present invention is intended to reduce the quality factor of the symmetrical oscillations, thereby encouraging the desired oscillation in antisymmetrical mode. This indeed means that each oscillation mode not only has its own frequency, but also its own quality factor. Within the context of the present description, $Q_2$ represents the quality factor of the unwanted symmetrical oscillation mode, whereas $Q_1$ represents the quality factor of the desired antisymmetrical mode. In general, the quality factor is defined by the equation $Q=2\pi\times$(energy stored/energy loss per period).

According to the preferred embodiments of the invention, the quality factor $Q_2$ is deliberately reduced by the construction of the tuning fork and particularly by the choice of the materials use in the construction of the tuning fork. Preferably, the quality factor $Q_2$ is reduced by the geometry of the tuning fork and/or the choice of position of the different materials with different characteristics.

According to a preferred embodiment, the oscillator of the invention comprises at least a second material that allows a reduction in the quality factor $Q_2$ of the symmetrical oscillation mode. This second material is generally referred to as material B in the present description. Material B is preferably chosen from among materials having higher friction than material A. Preferably, material B is a material with an internal friction higher than that of quartz and/or monocrystalline silicon for example. According to an embodiment, material B is selected from among metals, alloys, polycrystalline and amorphous materials for example.

The internal friction of a material is associated with the ability of a solid material to convert its mechanical vibrational energy into an internal energy. This inevitable decline or loss of energy manifests itself in several ways, for example by transformation of vibrational energy into heat. The quality factor of an oscillator and the internal friction of the material factor are interdependent, as described in the publication by Clarence Zener, "Internal Friction in Solids," Proceedings of the Physical Society 52 (1940), pp. 152-166, and also in the more recent publication by Hsi-Ping Liu and Louis Peselnick, "Internal Friction in Fused Quartz, Steel, Plexiglass, and Westerley Granite From 0.01 to 1.00 Hertz at $10^{-8}$ to $10^{-7}$ Strain Amplitude", Journal of Geophysical Research 88 (Mar. 10, 1983), pp. 2367-2379. In these publications, the inverse of the quality factor Q (i.e. 1/Q) is used as the measurement of internal friction.

Within the context of the present invention, the inverse of the quality factor 1/Q is preferably used to determine whether a given material is characterised by high or low internal friction. The quality factor Q of a material can be determined by those skilled in the art, as described in many publications dating from the past 50 years; refer to the references of the publication by Ilan Vardi, "Le facteur de qualité en horlogerie mécanique [The quality factor in mechanical watchmaking]", Bulletin de la Société Suisse de Chronométrie 75 (2014), pp. 53-61.

According to a preferred method, the quality factor Q of a material can be determined based on a simple vibrating blade that is caused to freely vibrate.

In the present description, in accordance with the articles quoted above, the internal friction of a material A can be represented by $1/Q_A$ and the internal friction of a material B can be represented by $1/Q_B$.

According to an embodiment, a material A having a low internal friction is a material, the 1/Q value of which $(1/Q_A)$ is <0.02, preferably <0.01. According to a preferred embodiment, a material having a low internal friction is a material, the 1/Q value of which $(1/Q_A)$ is <0.001.

In terms of internal friction, material A' fulfils the same conditions as material A. The 1/Q values for A' $(1/Q_{A'})$ are therefore within the same ranges as the 1/Q values for A $(1/Q_A)$.

According to an embodiment, a material B having a high friction or a higher friction than material A is a material, the 1/Q value of which $(1/Q_B)$ is ≥0.02, preferably ≥0.05, for example ≥0.1 or higher.

According to a preferred embodiment, materials A and A' have an internal friction $(1/Q_A)\leq 0.01$ and material B has an internal friction $(1/Q_B)>0.02$. Preferably, $1/Q_A<0.005$ and $1/Q_B\leq 0.015$.

Within the context of the present invention, materials A and B are generally chosen so that $1/Q_A<1/Q_B$. Defining materials A and B in relation to one another makes it possible to disregard the specific conditions under which the respective quality factor Q ($Q_A$, $Q_B$) was measured in order to determine the internal friction value of the material, provided the conditions are the same for determining $Q_A$ and $Q_B$ (for example 25° C. and two rods, one made of material A and another of material B, of identical dimensions).

According to a preferred embodiment, $(1/Q_A)/(1/Q_B)$ $(=Q_B/Q_A)$ is ≤0.5, preferably ≤0.2. According to a preferred embodiment, $Q_B/Q_A$ is ≤0.1, preferably ≤0.02, or even ≤0.01.

It should also be mentioned that the present invention contemplates adjustment of the internal friction of a material ($1/Q_A$ and/or $1/Q_B$) in order to obtain a material having the desired characteristics. For example, materials A and B may be mixtures, for instance composites comprising several substances or materials, chosen so as to obtain a material having an internal friction in accordance with the preferred values or proportions indicated above.

The inventors have surprisingly observed that symmetrical oscillations can be prevented by the geometrical configuration and/or or position of material B in the tuning fork. Preferably, material B is in contact with material A of the oscillator.

According to an embodiment, the tuning fork of the invention comprises a material B that is arranged and/or positioned so as to prevent or damp the symmetrical oscillations of the tuning fork.

According to an embodiment of the invention, presence of the material B allows damping of the transversal oscillations of the rod 6. Consequently, according to an embodiment of the invention, material A is a first material and said quality factor $Q_2$ is reduced by presence of a second material B, wherein this material B is in contact with said material A such that transversal oscillation of said rod 6 is damped.

According to an embodiment, said quality factor $Q_2$ of the symmetrical oscillation mode of said oscillator is reduced such that $Q_1/Q_2$ is equal to or greater than 2. Preferably, $Q_1/Q_2$ is equal to or greater than 5, or indeed equal to or greater than 10, equal to or greater than 20, equal to or greater than 50 or furthermore equal to or greater than 100, for example, equal to or greater than 200.

According to an embodiment of the tuning fork according to the invention, the quality factor $Q_1$ is at least an order of magnitude greater than the quality factor $Q_2$. The term "order of magnitude" means a difference of approximately a factor of 10. Preferably, the quality factor $Q_1$ is at least 1 to 3 orders of magnitude greater than the quality factor $Q_2$.

Those skilled in the art will appreciate that, within the context of the present invention, the quality factor Q is used at the same time to qualify both oscillation modes, antisymmetrical and symmetrical, shown in FIGS. 2 A and 2 B ($Q_1$ and $Q_2$) and as a parameter of the internal friction of a material. In the latter case, the inverse of the quality factor (1/Q) is employed. It should be mentioned that the state of the art describes several parameters that represent the internal friction of a material, such as the damping or loss factor tan 6, or the loss module G". Within the context of the present invention, the inverse of the quality factor Q is chosen, as proposed by C. Zener (1940) and H.-P. Liu et al (1983), especially because measurement of this parameter is well known to those skilled in the art in the field of watchmaking.

The second material or material B can be arranged in the rod 6 of the tuning fork. According to an embodiment of the invention, said material A is a first material and the rod 6 comprises or is formed of a second material B in contact with said first material.

According to an embodiment, the rod 6 is entirely manufactured from the material B.

Alternatively, the rod 6 includes such a material B or several materials which, overall, fulfill the characteristic of higher internal friction. It is considered advantageous if the material B is in contact with the material A. For example, the material B is in contact with the base 5 of the tuning fork. According to this embodiment, the material B is preferably at least at the interface between the material A and the rod 6.

Figure 3A:
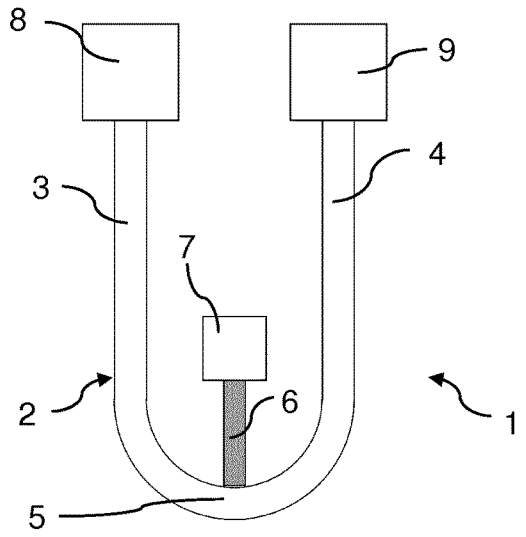
FIG. 3 A represents a diagrammatic view of a tuning fork according to a first embodiment of the invention.
Figure 3B:
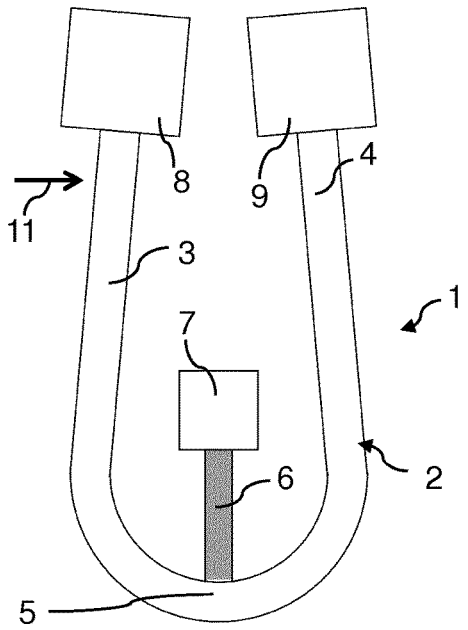

This embodiment is illustrated by FIGS. 3 A to 3 C, in which the rod 6 consists of a material B that is different from the material A from which the assembly 2 is made. The assembly 2 comprises in particular the two prongs 3, 4 and the base 5.

The reference numbers of FIGS. 3 A to 3 C have the same meanings as described above for FIG. 1. FIG. 3 A shows the tuning fork in the resting position, while FIGS. 3 B and 3 C show the antisymmetrical and symmetrical oscillations, respectively, following an impulse transmitted to one of the two prongs (in this case on the prong 3) at the position of the arrow 11.

Figure 3C:
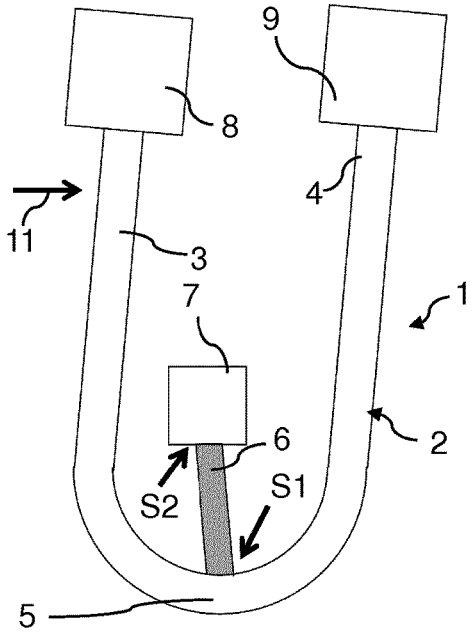

In the embodiment illustrated in FIGS. 3 A to 3 C, the assembly 2 is constructed entirely from materials of type A, i.e. with low internal friction, but the rod 6 consists of a material having a higher internal friction (material B), for example the metal used for the conventional watchmaking tuning fork. In this embodiment, the asymmetrical oscillations in FIG. 2 A do not experience any loss by the rod 6, owing to the latter's transversal movement, while the symmetrical oscillations of the tuning fork (FIG. 2 B) are damped owing to the energy lost at the attachment or the connection between the rod 6 and the base 5 and between the rod 7 and the fastening 7 of the tuning fork due to the constraints S1 and S2, refer to FIG. 3C. The quality factor ($Q_2$) of the symmetrical oscillations would therefore be similar to the quality factor of a simple vibrating blade embedded at the end made of this material B and therefore very small (for example <10).

The rod 6, manufactured from material B having a higher internal friction than the material A of which the assembly 2 is made, does not damp and does not reduce the quality factor ($Q_1$) of the antisymmetrical oscillations illustrated in FIG. 3 B. This likewise applies to a case in which the tuning fork 1 is caused to oscillate by an impulse on one prong only, illustrated by the arrow 11.

It was stated in U.S. Pat. No. 3,447,311 that the rod, preferably, displays certain flexibility or elasticity as a whole, which makes it possible to separate or distance the frequency of the symmetrical oscillations from the frequency of the antisymmetrical oscillations. According to an embodiment, the rod 6 is arranged so as to retain sufficient flexibility and/or elasticity in order to separate the frequencies specific to the antisymmetrical and symmetrical mode. This arrangement can be created by the geometric shape and/or form of the rod 6 and by the material of which it is made. By varying the geometry of the rod, for example by reducing its width and/or increasing its length, it is possible to increase its flexibility and thus retain the required elasticity. Preferably, the natural frequencies of the symmetric and antisymmetric oscillations is different and/or distant from one another. "Natural frequency" means the concept of resonance frequency, in which the amplitude is maximum in relation to the impulse frequency.

For example, the natural frequencies of the symmetrical and antisymmetric oscillations are separated by at least 5 Hz, preferably by at least 10 Hz, even least 20 Hz and in some instances even 30 Hz.

According to an embodiment of the invention, the rod 6 forms part of said assembly 2 comprising the prongs 3, 4 and the base 5 and comprises or is formed of said material A. According to this embodiment, illustrated in FIGS. 4 A to 4 C, the rod 6, base 5 and prongs 3, 4 may be manufactured in one piece, for example from a continuous material A, or may include a continuous material A. In the case of a monocrystalline material, the rod 6, base 5 and prongs 3, 4 may comprise or be formed of a single crystal.

Figure 4A:
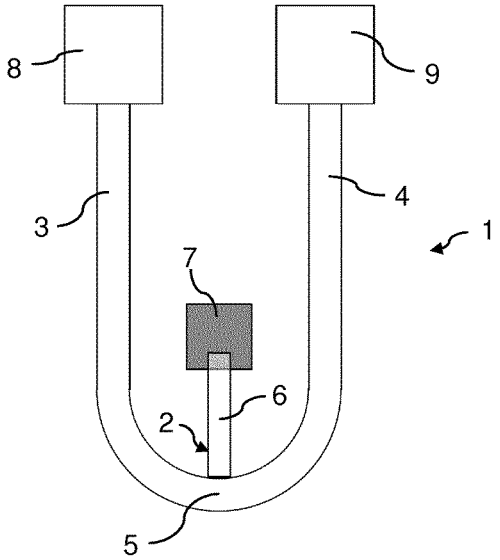
FIG. 4 A represents a diagrammatic view of a tuning fork according to a second embodiment of the invention.
Figure 4B:
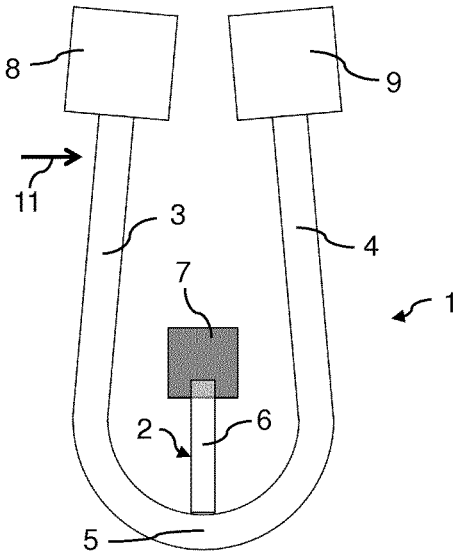
Figure 4C:
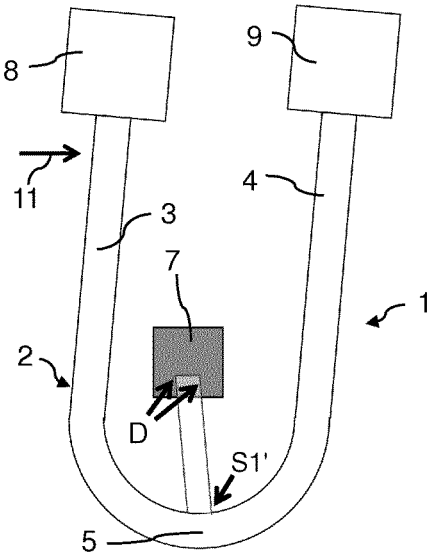

As shown in FIG. 4 A, the fastening 7 comprises or is made of a material with a higher internal friction than that of material A. In this case, the rod 6 may or may not comprise a material with a higher internal friction (material B). As indicated, FIGS. 4 A to 4 C show in particular the possibility of the rod comprising and/or being manufactured from the same material A as the base 5 and the prongs 3, 4 and the fastening 7, illustrated by a dark square, being formed of material B. The present invention naturally does not rule out the possibility that the rod may comprise a material other than material A of the base 5 and of the prongs 3, 4, wherein this other material has a low internal friction, like material A, or a higher internal friction, like material B.

According to an embodiment of the invention, said material A is a first material and said fastening member 7 comprises a second material B in contact with said rod 6.

In the embodiment shown in FIGS. 4 A to 4 C, damping of the symmetrical oscillations is introduced at the fastening 7, by replacing material A of the fastening with a material that dissipates the oscillations of the rod 6. The rod 6 made of material A is therefore embedded in a base formed by the 7 fastening made of a material having a high internal friction, such as the metal of the watchmaking tuning fork, or another material such as a resin (material B).

It may also be contemplated that the rod 6 made of material A is glued to the fastening 7 using an adhesive that could serve for damping, therefore a loss of energy in symmetrical mode and a reduction in the quality factor of the symmetrical mode. The adhesive comprises and/or constitutes the material B. In this case, the fastening 7 could also be manufactured from a material selected from among the materials of type A. The antisymmetrical oscillations are not damped by the fastening, since there are no transversal oscillations of the rod 6 in the dissipative embedding 7; refer to FIG. 4 B. On the other hand, the symmetrical oscillations are damped since the oscillations of the rod 6 are damped owing to its fastening in the dissipative material 7, as indicated by the arrows D in FIG. 4 C. In this case, the constrain S1' between the rod and the base of the tuning fork does not dissipate any more energy than if the tuning fork and its fastening were entirely made of material A. Constraint S1' therefore does not contribute to reducing the symmetrical oscillations.

In an embodiment, said fastening member 7 fixes and/or embeds said rod 6 such that transversal oscillation of said rod 6 is damped. This embedding of the rod 6 is clearly illustrated in FIGS. 4 A to 4 C, in which the contact of the fastening 7 with the rod 6 causes dissipation of energy of the oscillations.

It should be added that the dissipation of energy arising from damping of the symmetrical oscillations as illustrated in FIGS. 3 C and 4 C may result in an increase in temperature, i.e. the energy of the oscillations is transformed into heat. The loss of energy associated with an oscillation mode (in this case symmetrical oscillation) explains the reduction in quality factor of this type of oscillation. According to the present invention, the material B is positioned and/or arranged so as to cause in particular a loss of energy of the symmetrical oscillations in order to reduce the quality factor $Q_2$. Preferably, the material B is arranged so as to dampen the transverse oscillations of the rod 6. As the person skilled in the art can understand, the present invention seeks to utilise the difference between the antisymmetrical oscillations in FIG. 2 A and the symmetrical oscillations in FIG. 2 B, such as it occurs at the movement of the rod 6. It will also be noted that the centre of gravity of the tuning fork is almost immobile in the antisymmetrical case but performs a perceptible movement in the symmetrical case.

According to an embodiment, said prongs 3, 4 of the tuning fork 1 according to the invention comprise a material A', wherein said material A' is arranged in the form of a layer on at least a portion of the two blades. According to an embodiment, said material A' is characterised by a low internal friction similar to that of material A. Preferably, the internal friction of the material A' is of the same order of magnitude as that of material A.

According to an embodiment, material A and material A' differ in relation to the (positive or negative) sign of their respective thermal expansion coefficient. Consequently, the thermal expansion coefficient of said material A' has an opposite sign in relation to the sign of the thermal coefficient of said material A. In other words, if the thermal dilation coefficient of material A is positive, for example +0.5, that of material A' is negative, for example −1.0.

A purpose of the choice of two materials, A and A' with low internal friction is to cancel or at least partially compensate the effect of temperature on the frequency of the oscillations. Generally, the frequency of the oscillations decreases following a deviation from optimum temperature (generally 25° C.) of a tuning fork due to increase or reduction in the volume of the material of which the tuning fork is made. Since material A' preferably has an expansion coefficient of opposite sign to that of material A, the presence of A' reduces the change in volume of the assembly A and A'.

The characteristic of the opposite sign does not mean that the absolute values of the thermal expansion coefficients of materials A and A' are identical (refer to the example of the values +0.5 and −1.0 given above). For this reason, the quantity of material A' is preferably chosen such that a change in the volume of the assembly comprising at least the prongs 3, 4 and the base 5, in addition to the rod 6 if appropriate, is reduced as much as possible, i.e. the expansion or decrease in volume are essentially reduced or absence.

Preferably, material A' is also a material with a low internal friction. Hence, material A' preferably does not have any significant effect on the quality factor $Q_1$. The person skilled in the art is familiar with materials with a negative thermal expansion coefficient.

Material A' is preferably present at least on both prongs 3, 4. Material A' may also be present on the base 5. If the rod 6 comprises or consists of material A, (FIGS. 4 A to 4 C), material A' may also be present on the rod. It is understood that the present invention is not limited to the way in which material A' is combined with material A. For example, material A' may be applied in the form of a layer on at least a portion of material A or vice versa. The person skilled in the art may contemplate other ways of combining material A' with the tuning fork according to the invention. Said layer may extend over the whole of one side of the prongs 3, 4 and the base 5 and likewise over the rod, or may be present on a portion of the assembly 2 only. Preferably, the material A' is at least associated with and/or connected to a portion of the prongs 3, 4. Preferably, material A' is arranged evenly and/or symmetrically over both prongs 3, 4.

The person skilled in the art will encounter no particular difficulty in adapting the contents of the present disclosure to his or her own needs, and in implementing an oscillator different from that according to the embodiments described here, but in which the quality factor of the symmetrical oscillations is reduced in relation to the quality factor of the antisymmetrical oscillations, without going beyond the ambit of the present invention. For example, a person skilled in the art will be able to use the oscillator according to the invention in a timepiece that is not entirely mechanical and/or in an electronic timepiece, or furthermore in any kind of electronic time base. For example, the present invention can be easily implemented in an application that requires a time base, such as a computer or even a mobile phone. In particular, the fact that the present invention is able to stimulate and/or sustain the antisymmetrical impulses in spite of the impulses (mechanical or others) on only one of the two prongs facilitates construction of the tuning fork in general, including in the case of a tuning fork caused to oscillate by electronic means and/or using the piezoelectric effect in the case of a quartz tuning fork, for instance.

The invention claimed is:

1. A timepiece having a mechanical clock movement comprising:

a tuning fork oscillator, wherein said oscillator includes an assembly having two prongs and a base connecting said prongs, wherein said oscillator includes a rod connected to said base, the oscillator being connected by said rod to a fastening member connected to the movement, a first end of said rod being connected to the fastening member and a second end of said rod being connected to the base, said rod being configured to oscillate transversely in a symmetrical oscillation mode and oscillate longitudinally in an antisymmetrical oscillation mode, wherein said assembly includes a material A, said material A having low internal friction, wherein said movement includes a mechanical impulsion element able to act on one of the two prongs so as to induce and sustain oscillation of said oscillator, wherein said oscillator includes a material which is able to oscillate both in the antisymmetrical oscillation mode and the symmetrical oscillation mode, and wherein a quality factor $Q_2$ of the symmetrical oscillation mode of said oscillator is reduced in relation to a quality factor $Q_1$ of the antisymmetrical oscillation mode.

2. The timepiece according to claim 1, wherein said material A is a first material and said quality factor $Q_2$ is reduced by presence of a second material B, wherein said material B is in contact with said material A such that transversal oscillation of said rod is damped.

3. The timepiece according to claim 2, wherein said material B has a higher internal friction than that of said material A.

4. The timepiece according to claim 2, wherein said second material is selected from among metals, alloys, polycrystalline and/or amorphous materials.

5. The timepiece according to claim 1, wherein said material A is a first material and the rod includes a second material B in contact with said first material.

6. The timepiece according to claim 1, wherein the rod forms part of said assembly including the prongs and the base and is formed of said material A.

7. The timepiece according to claim 1, wherein said material A is a first material and said fastening member includes a second material B in contact with said rod.

8. The timepiece according to claim 1, wherein said fastening member fixes and/or embeds said rod such that transversal oscillation of said rod is damped.

9. The timepiece according to claim 1, wherein said oscillator includes monocrystalline silicon and/or quartz.

10. The timepiece according to claim 1, wherein said prongs include a material A', wherein said material A' is arranged in a form of a layer on at least a portion of the two prongs.

11. The timepiece according to claim 10, wherein said material A' has a low internal friction similar to that of said material A.

12. The timepiece according to claim 10, wherein a thermal expansion coefficient of said material A' has an opposite sign (+/−) in relation to the thermal coefficient sign of said material A.

13. A turning fork oscillator comprising:

an assembly having two prongs and a base connecting said prongs, wherein said oscillator includes a rod connected to said base, the oscillator being connected by said rod to a fastening member connected to a support, a first end of said rod being connected to the fastening member and a second end of said rod being connected to the base, wherein said rod is configured to pivot about the first end that is connected to the fastening member, and oscillate transversely in a symmetrical oscillation mode and oscillate longitudinally in an antisymmetrical oscillation mode, wherein said assembly is formed of a material A, wherein said material A is a first material and wherein said oscillator includes a second material B, and wherein said material B is in contact with said material A such that transversal oscillation of said rod is damped.

14. The turning fork oscillator according to claim 13, wherein said material B has an internal friction ($1/Q_B$) higher than the internal friction ($1/Q_A$) of said material A, such that $Q_B/Q_A$ is $\leq 0.1$.

15. A clock movement comprising the turning fork oscillator of claim 13, wherein said movement includes a mechanical impulsion member capable of acting on one of the two prongs in order to induce and sustain oscillation of said oscillator.

16. The clock movement according to claim 15, wherein said mechanical impulsion member is connected to and/or powered by a source of mechanical energy.

* * * * *